US005471935A

United States Patent [19]

Goebels et al.

[11] Patent Number: 5,471,935

[45] Date of Patent: Dec. 5, 1995

[54] LINKING PLATFORM

[75] Inventors: Andre Goebels, Niederbeisheim; Heinrich Wunsch, Felsberg; Emil Veit-Salomon, Berlin, all of Germany

[73] Assignee: Huebner Gummi- und Kunststoff-GmbH, Kassel, Germany

[21] Appl. No.: 323,759

[22] Filed: Oct. 17, 1994

[30] Foreign Application Priority Data

Feb. 25, 1994 [EP] European Pat. Off. ..... 94102853

[51] Int. Cl.[6] ..... B61D 49/00

[52] U.S. Cl. ..... 105/458

[58] Field of Search ..... 105/458, 459, 105/3; 296/61, 166; 104/245, 246

[56] References Cited

U.S. PATENT DOCUMENTS

| | | | |
|---|---|---|---|
| 68,543 | 9/1867 | Abbot | 105/458 |
| 445,897 | 2/1891 | Fountaine | 105/458 |
| 686,797 | 11/1901 | Anderson | 105/458 |
| 714,312 | 11/1902 | Long | 105/458 |
| 5,010,614 | 4/1991 | Braemert et al. | 105/458 |
| 5,031,544 | 7/1991 | Braemert et al. | 105/458 |
| 5,267,514 | 12/1993 | Staehs et al. | 104/246 |

FOREIGN PATENT DOCUMENTS

| | | | |
|---|---|---|---|
| 0331121 | 5/1992 | European Pat. Off. . | |
| 0493818 | 7/1992 | European Pat. Off. . | |
| 0539581 | 11/1931 | Germany | 105/458 |
| 0806859 | 6/1951 | Germany | 105/458 |

*Primary Examiner*—Mark T. Le
*Attorney, Agent, or Firm*—Collard & Roe

[57] ABSTRACT

A diagonally movable linking platform forming part of a bridge between two vehicles. The linking platform is supported by the vehicles. The linking platform has two parallel extending supports for pivotally receiving the cross-beams. The supports each have a pair of guide and support rollers. The guide and support rollers are received by guide and support elements arranged on the vehicles.

6 Claims, 2 Drawing Sheets

LINKING PLATFORM

BACKGROUND OF THE INVENTION

1. Field of the Invention

The invention relates to a linking platform positioned between two vehicles. The linking platform is movable relative to the vehicles and has two parallel supports for pivotally supporting the individual platform components.

2. The Prior Art

A linking platform of the type specified above is known, for example from EP-PS 0 331 121. The prior art linking platform has a carriage, which is displaceably supported in a trough of the vehicle with a certain adjustment length. Since the carriage is slidingly supported in the trough, there is always the risk that the carriage is set on edge in the trough. In such a case, compression or excessive expansion of the linking platform is possible. Furthermore, it has been found that the known device according to EP 0 331 121 is relatively expensive to manufacture because of the costly construction with respect to the support of the carriage in the trough of the vehicle.

SUMMARY OF THE INVENTION

It is the therefore an object of the present invention to provide a linking platform that operates dependably and which, moreover, can be manufactured at a reasonable cost.

These and other related objects are achieved according to the invention by having each support equipped with a pair of guide and support rollers, whereby the guide and support rollers are receivable by guide and support elements arranged on the vehicles. As compared to the state of the art, the design according to the invention no longer requires two carriages for guiding each end of the support in a trough of the vehicle, but only eight rollers. The rollers are guided and supported by two pairs of U-shaped rails arranged on the vehicles in the direction of the longitudinal axis of the vehicle. The rails form the guide and support elements. By using rollers instead of carriages arranged at both sides of the linking platform, the swivel axis is located along the axis of rotation of the support roller when the vehicles are displaced relative to each other. The state of the art, according to the aforementioned European Patent specification, make provision for a separate swivel axis.

Another advantage of the design according to the invention lies in that the linking platform no longer has to be uncoupled separately when the two vehicles are disengaged, because the linking platform itself is not fixedly connected with the vehicles. However, the linking platform, during operation, still cannot slide out of the guide and support elements arranged on the vehicles, because the vehicles themselves are coupled to each other. The relative motion of the vehicles relative to one another can be compensated by suitably lengthening the distance that the linking platform runs into the rails. In the uncoupled condition, the linking platform is supported by the underlying transition, on the one hand, and by a diagonal supporting cable.

The support roller is rotatably supported, by a fork vertically arranged on the support, and the guide roll is rotatably supported by a vertical axle on an arm arranged on the support. In this connection, the guide roller rests against the platform of the U-shaped rail, whereby the support roller rolls on the one lower leg of the U-shaped rail.

According to another feature of the invention, the cross-beams, i.e. both the steps and the intermediate cross-beams of the linking platform are received by the supports in the direction of the longitudinal axis of the vehicle. Such a construction has been found to be useful when the linking platform has a greater width than length, the reason being that a linking platform structured in such a way has less deflection than a linking platform whose cross-beams are supported transversely to the longitudinal direction of the vehicle.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
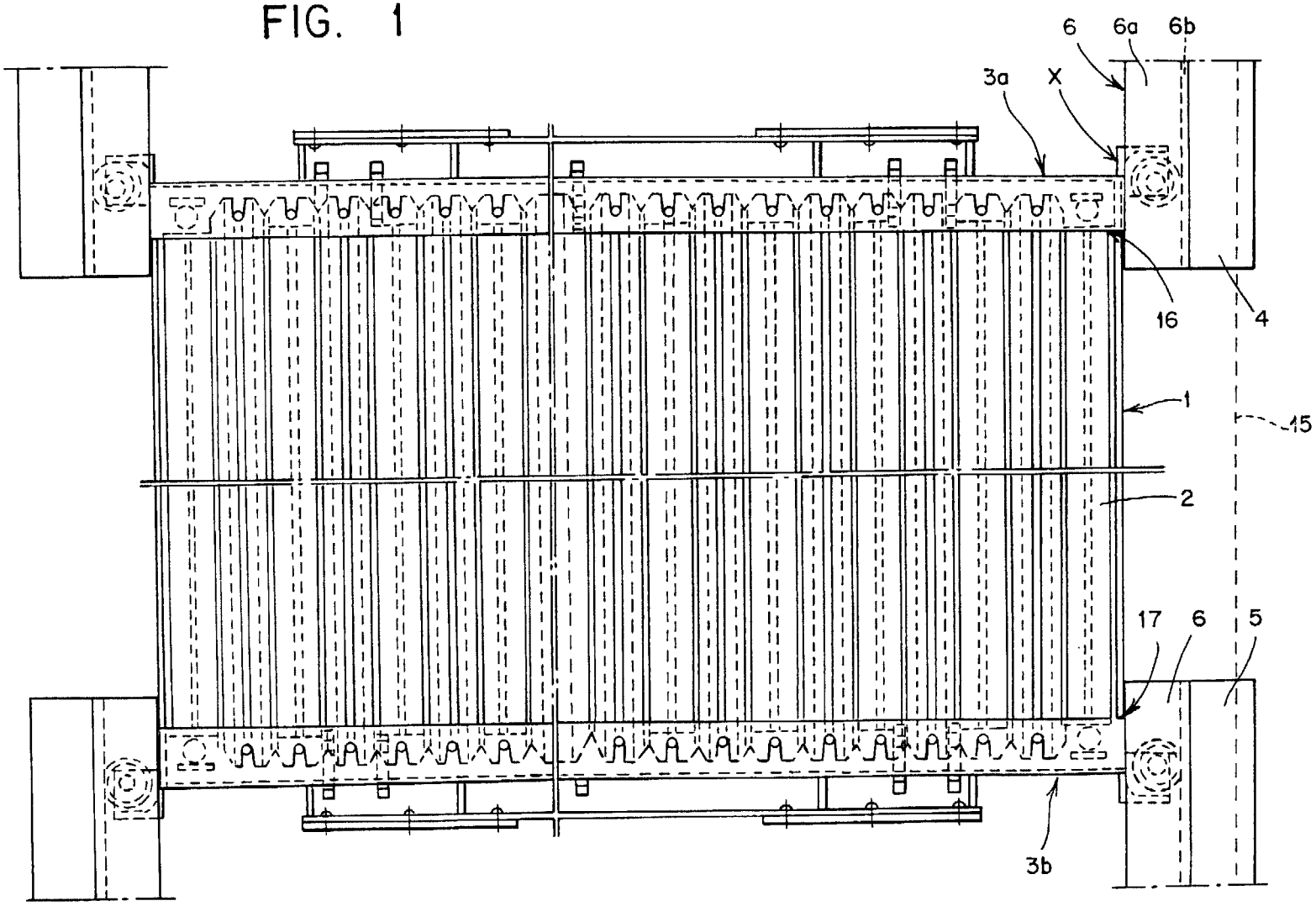
FIG. 1 is a top plan view of an embodiment of the linking platform, according to the invention.
Figure 2:
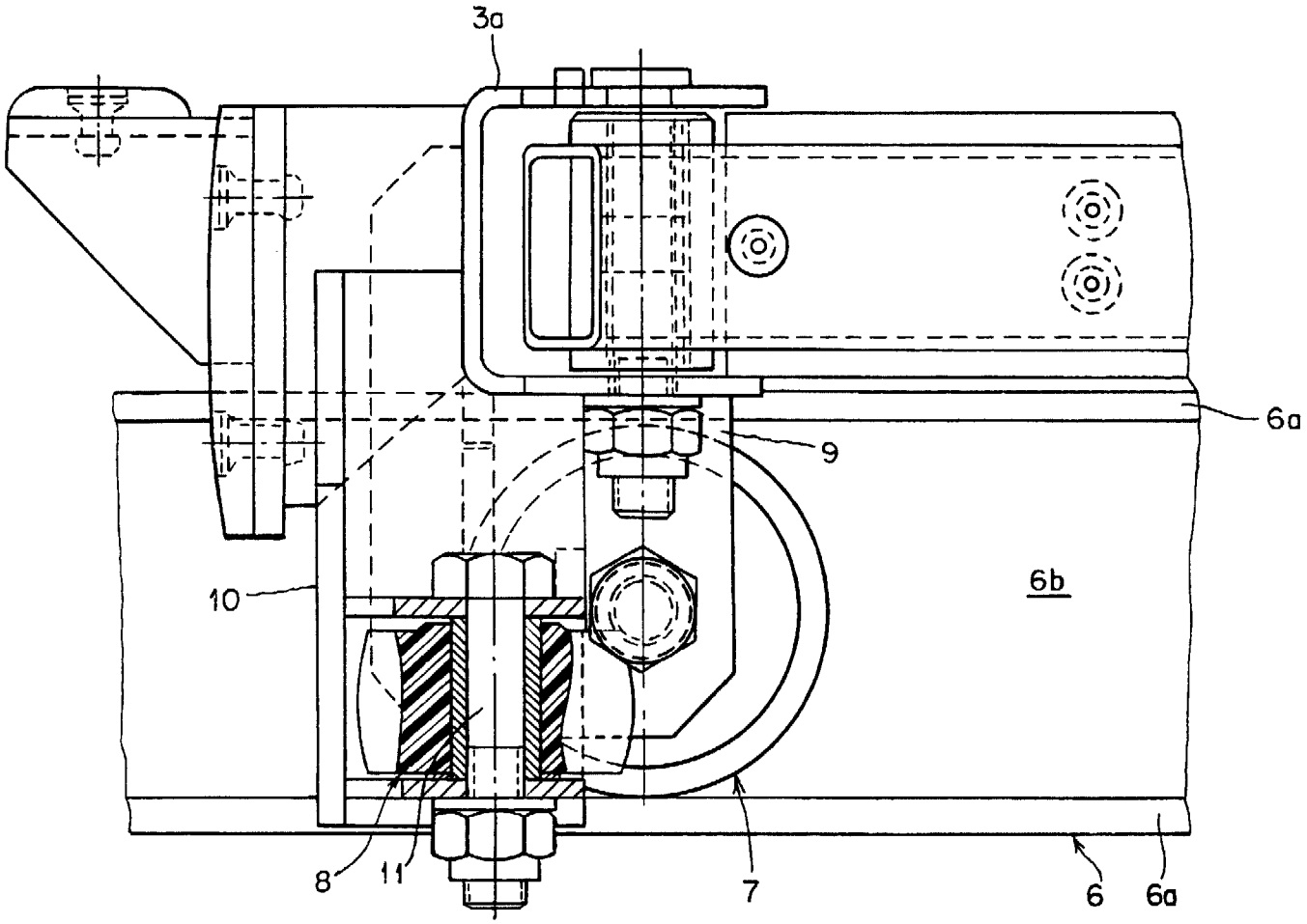
FIG. 2 is an enlarged side elevational view of detail X from FIG. 1.

Referring now in detail to the drawings and in particular FIGS. 1 and 2, there is shown a linking platform 1 having platform components or cross-beams 2 extending parallel to a longitudinal axis 15 of vehicles 4 and 5. Each end 16 and 17 of each cross-beam is pivotally supported on one of supports 3*a* and 3*b*. Supports 3*a* and 3*b* are disposed transversely to longitudinal axis 15 of the vehicle and each end includes a support roller 7 and a guide roller 8.

Each vehicle 4 and 5, as shown in FIG. 1, has a U-shaped support and guide rail 6, which also extends parallel to longitudinal axis 15, and which receives support roller 7 and guide roller 8. Guide rail 6 includes a bridge portion 6*b* and legs 6*a*. The support roller 7 rolls on one leg 6*a* of rail 6, whereas the guide roller 8 supports itself against the bridge 6*b* of the U-shaped rail 6. The pair of guide rollers on supports 3*a* and 3*b* is guided by the two bridges 6*b* of the two parallel-extending rails 6.

FIG. 2 shows a vertically-aligned fork 9 mounted on an end of support 3, which rotatably receives support roller 7. An arm 10 is also arranged on support 3 and carries a vertical axle 11. Guide roller 8 is rotatably supported on linking platform whose cross-beams are supported by supports transversely to the longitudinal direction of the vehicle.

While several embodiments of the present invention have been shown and described, it is to be understood that many changes and modifications may be made thereunto without departing from the spirit and scope of the invention as defined in the appended claims.

What is claimed is:

1. A linking platform forming part of a bridge between two movable vehicles, each having a support rail, the linking platform comprising:

a pair of spaced parallel supports, each having two spaced opposite ends;

a plurality of parallel cross-beams extending between said supports approximately perpendicular to said supports and pivotally connected to said supports for relative diagonal movement therebetween:

a support roller rotatably mounted on each of said ends for movably supporting said supports on said rail; and a guide roller rotatably mounted on each of said ends transverse to said support roller, for movably guiding said supports against said rail.

2. The device according to claim 1, wherein the support rail is a U-shaped rail extending in the longitudinal direction, said U-shaped rail having a bridge portion and two legs.

3. The device according to claim 1, comprising a fork vertically mounted on each support, wherein each of said support rollers is rotatably mounted on a corresponding fork.

4. The device according to claim 1, comprising an arm and a vertical axle on each end of each support, wherein each guide roller is rotatably mounted on said axle.

5. The device according to claim 2, wherein said guide roller rests against said bridge portion and said support roller rolls on one of said legs.

6. The device according to claim 1, wherein the bridge is separable from the vehicles.

* * * * *

UNITED STATES PATENT AND TRADEMARK OFFICE

CERTIFICATE OF CORRECTION

PATENT NO. : 5,471,935

DATED : DECEMBER 5, 1995

INVENTOR(S) : GOEBELS ET AL

It is certified that error appears in the above-indentified patent and that said Letters Patent is hereby corrected as shown below:

Cover page, item [75] , delete Emil Veit-Salomon, Berlin.

Signed and Sealed this

Thirteenth Day of February, 1996

*Attest:*

Bruce Lehman

BRUCE LEHMAN

*Attesting Officer*

*Commissioner of Patents and Trademarks*